US009480315B2

(12) United States Patent
Goodale

(10) Patent No.: US 9,480,315 B2
(45) Date of Patent: Nov. 1, 2016

(54) CONVERTIBLE PURSE WITH INTERCHANGEABLE COVERS

(71) Applicant: Natalie Jane Goodale, Northampton, MA (US)

(72) Inventor: Natalie Jane Goodale, Northampton, MA (US)

( * ) Notice: Subject to any disclaimer, the term of this patent is extended or adjusted under 35 U.S.C. 154(b) by 133 days.

(21) Appl. No.: 14/087,621

(22) Filed: Nov. 22, 2013

(65) Prior Publication Data

US 2014/0150936 A1 Jun. 5, 2014

Related U.S. Application Data

(60) Provisional application No. 61/796,897, filed on Nov. 24, 2012.

(51) Int. Cl.

| | |
|---|---|
| ***A45C 3/08*** | (2006.01) |
| *A45C 13/10* | (2006.01) |
| *A45F 3/02* | (2006.01) |

(52) U.S. Cl.

CPC ..... *A45C 3/08* (2013.01); *A45C 13/1046* (2013.01); *A45F 3/02* (2013.01)

(58) Field of Classification Search

CPC ..... A45C 3/08; A45C 3/06; A45C 13/08; A45C 13/02; A45C 7/0086; A43B 3/24

USPC ..... 150/105, 100, 103, 104, 106, 111, 113, 150/112; 36/100; 383/43, 111; 190/110

See application file for complete search history.

(56) References Cited

U.S. PATENT DOCUMENTS

| | | | | |
|---|---|---|---|---|
| 2,609,854 | A * | 9/1952 | Rosen | A45C 3/08 150/104 |
| 4,112,991 | A * | 9/1978 | Barbaresi | A45C 13/00 150/104 |
| 4,649,974 | A | 3/1987 | Takanashi | |
| 4,707,889 | A | 11/1987 | Sato | |
| 4,716,947 | A | 1/1988 | Haddock | |
| 4,754,790 | A * | 7/1988 | Meyers | A45C 3/08 150/104 |
| 4,907,633 | A * | 3/1990 | Eckstein | A45C 3/08 150/105 |
| 4,953,674 | A | 9/1990 | Landes | |
| 5,009,319 | A | 4/1991 | Jantzen | |
| 5,010,987 | A | 4/1991 | Evans | |
| 5,083,644 | A | 1/1992 | Collins, III | |
| 5,107,971 | A | 4/1992 | Freeman | |
| 5,172,795 | A | 12/1992 | Riceman | |
| 5,207,254 | A * | 5/1993 | Fromm | A45C 3/08 150/104 |
| 5,209,279 | A * | 5/1993 | Wilson | A45C 3/06 150/111 |
| 5,293,975 | A | 3/1994 | Howorka | |
| 5,503,204 | A | 4/1996 | Byers et al. | |
| 5,533,558 | A | 7/1996 | Carey et al. | |
| 5,547,051 | A | 8/1996 | Bartscht et al. | |
| 5,649,581 | A | 7/1997 | Kopel | |
| 5,704,528 | A | 1/1998 | Faure | |
| 5,725,039 | A | 3/1998 | Macinai et al. | |
| 5,954,014 | A | 9/1999 | Wamsley | |
| 6,029,723 | A | 2/2000 | Baquero et al. | |
| 6,129,126 | A | 10/2000 | Restivo | |

(Continued)

*Primary Examiner* — Fenn Mathew
*Assistant Examiner* — Cynthia Collado
(74) *Attorney, Agent, or Firm* — Paul & Paul

(57) ABSTRACT

A convertible purse can be interconverted between a handbag, shoulder bag, drawstring bag, messenger bag, and backpack. The convertible purse also has interchangeable covers that allow the user to change the appearance of the convertible purse.

19 Claims, 5 Drawing Sheets

(56) References Cited

U.S. PATENT DOCUMENTS

| | | | | |
|---|---|---|---|---|
| 6,179,025 | B1 | 1/2001 | Sutton | |
| 6,186,201 | B1 * | 2/2001 | Salz | A45C 3/08 150/104 |
| 6,234,287 | B1 | 5/2001 | Pfeiffer | |
| 6,237,660 | B1 | 5/2001 | Giardino | |
| 6,382,280 | B1 | 5/2002 | Sands | |
| 6,382,376 | B1 | 5/2002 | Rosen et al. | |
| 6,422,278 | B1 | 7/2002 | Grogan | |
| 6,446,688 | B1 | 9/2002 | Sutton | |
| 6,637,562 | B2 | 10/2003 | Oh | |
| 6,807,992 | B2 | 10/2004 | Powers | |
| 6,820,664 | B1 * | 11/2004 | Ritch | A45C 3/08 150/103 |
| 6,971,424 | B1 * | 12/2005 | Angevine | A45C 3/08 150/103 |
| 6,994,131 | B2 | 2/2006 | Dedmon | |
| 7,028,730 | B2 * | 4/2006 | Pace | A45C 13/02 150/103 |
| 7,077,251 | B1 | 7/2006 | Gaither | |
| 7,086,437 | B1 * | 8/2006 | Michael | A45C 7/009 150/103 |
| 7,160,028 | B1 | 1/2007 | Linday | |
| 7,222,649 | B1 | 5/2007 | Fox | |
| 7,240,778 | B2 | 7/2007 | Duncanson et al. | |
| 7,246,643 | B2 | 7/2007 | Andrews | |
| 7,461,676 | B2 * | 12/2008 | Huie | A45C 3/08 150/105 |
| 7,607,461 | B2 | 10/2009 | Pace et al. | |
| 7,628,187 | B2 * | 12/2009 | Mittelstaedt | A45C 3/08 150/105 |
| 7,789,114 | B2 * | 9/2010 | Pace | A45C 3/08 150/103 |
| 7,886,786 | B1 | 2/2011 | Christie | |
| 7,946,322 | B2 | 5/2011 | Valvano et al. | |
| 8,152,374 | B2 | 4/2012 | Shaul | |
| 8,156,974 | B2 | 4/2012 | Pace et al. | |
| 8,220,510 | B2 | 7/2012 | Armstrong et al. | |
| 8,251,113 | B2 | 8/2012 | Baxter | |
| 8,302,642 | B1 | 11/2012 | Lindholm | |
| 8,302,749 | B2 | 11/2012 | Melmon et al. | |
| 8,475,045 | B2 | 7/2013 | Meyer et al. | |
| 9,226,557 | B2 * | 1/2016 | Sullivan | A45C 3/001 |
| 2001/0015248 | A1 * | 8/2001 | McCreery | A45C 3/08 150/104 |
| 2003/0177664 | A1 * | 9/2003 | Monassebian | A43B 1/0027 36/100 |
| 2004/0090773 | A1 * | 5/2004 | Bryan | A45C 3/08 362/156 |
| 2006/0021684 | A1 * | 2/2006 | DeCoro, III | A45C 3/08 150/105 |
| 2008/0235985 | A1 * | 10/2008 | Gordon | A43B 1/0009 36/7.1 R |
| 2012/0125496 | A1 | 5/2012 | Hedaya | |
| 2015/0136282 | A1 * | 5/2015 | Blakeslee | A45C 3/08 150/103 |

* cited by examiner

CONVERTIBLE PURSE WITH INTERCHANGEABLE COVERS

CROSS REFERENCE TO RELATED APPLICATIONS

This application claims the priority of U.S. Provisional Application for Patent Ser. No. 61/796,897, filed on Nov. 24, 2012, which is incorporated herein by reference in its entirety.

BACKGROUND OF THE INVENTION

1. Field of the Invention

The present invention relates to a purse that can be interconverted between different bag styles. In addition, the appearance of the purse in accordance with the present invention can be changed using different interchangeable covers.

2. Description of the Prior Art

There are several purses, handbags, and pocketbooks already in existence that allow for their covers to be changed and therefore for their colors to be matched to new outfits. Many of them, however, employ complicated techniques for changing the covers, using complex systems of latches and snaps.

Still other examples of prior art employ simpler techniques to change the covers, but the outsides of the bags never fully become encompassed by the new covers; there are always pieces of the base still showing, requiring women to still match their outfits with the exposed pieces of the base, whether they be black, brown, or different colors.

Additionally, these existing purses that allow their covers to be changed do not have the ability to convert the purse easily from a shoulder bag into a drawstring bag/backpack or messenger bag.

Similarly, there are existing handbags that convert into backpacks or other carrying styles, but they do not allow for the changing of their covers. Also, many of these bags that allow for the user to change how they are carried do not fully convert; a backpack converted to a handbag still resembles a backpack, and vice versa.

SUMMARY OF THE INVENTION

The present invention is a purse that not only introduces a new technique for changing its covers, but it also converts into different ways of being carried. The purse in accordance with the present invention achieves all these results without sacrificing fashion and style.

The primary features of the convertible purse with interchangeable covers according to the present invention are: A) The user can easily take off the purse's cover and replace it with another one to change the appearance of the purse, and B) the user can convert the purse from a shoulder bag into a drawstring bag/backpack or a messenger bag as desired.

Some of the advantages of the convertible purse with interchangeable covers in accordance with the present invention are as follows:

The convertible purse with interchangeable covers of the present invention employs a much simpler way of taking the cover off and attaching a new one.

The convertible purse with interchangeable covers of the present invention allows the user to completely change the outside of the bag to a new pattern or color, with none of the base exposed.

The convertible purse with interchangeable covers of the present invention is capable of being easily converted from a shoulder bag into a drawstring bag/backpack or messenger bag.

The convertible purse with interchangeable covers of the present invention completely converts into any of the various styles of bag such as a handbag, a shoulder bag, a drawstring bag, a messenger bag, and a backpack.

Accordingly, it is an object of the invention to provide a convertible purse with interchangeable covers that employs a much simpler way of taking the cover off and attaching a new one.

It is another object of the invention to provide a convertible purse with interchangeable covers that allows the user to completely change the outside of the bag to a new pattern or color, with none of the base exposed.

It is yet another object of the invention to provide a convertible purse with interchangeable covers that is capable of being easily converted from one style of bag to another style of bag.

These and other objects of the present invention will become apparent from the attached description and drawings.

DETAILED DESCRIPTION OF THE PREFERRED EMBODIMENTS

Figure 1:
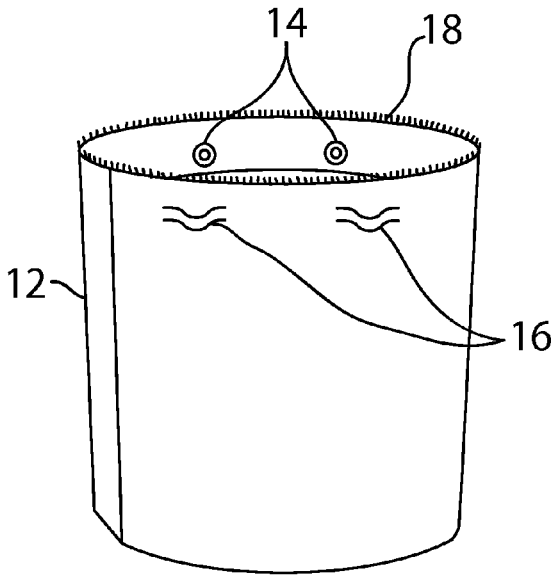
FIG. 1 is a front view of the base purse.
Figure 2:
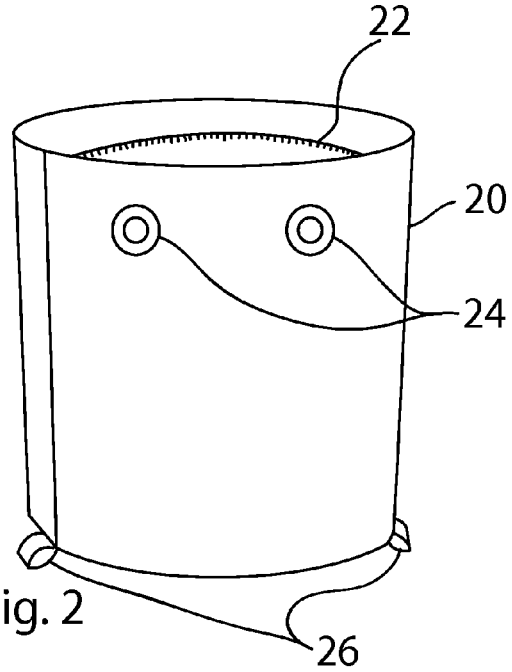
FIG. 2 is a front view of the purse cover.
Figure 3:
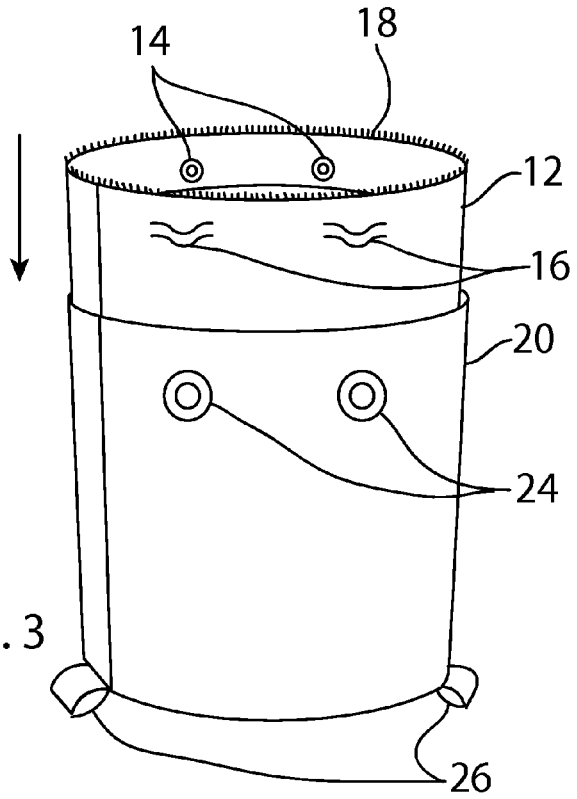
FIG. 3 shows the base purse being placed inside the purse cover.
Figure 4:
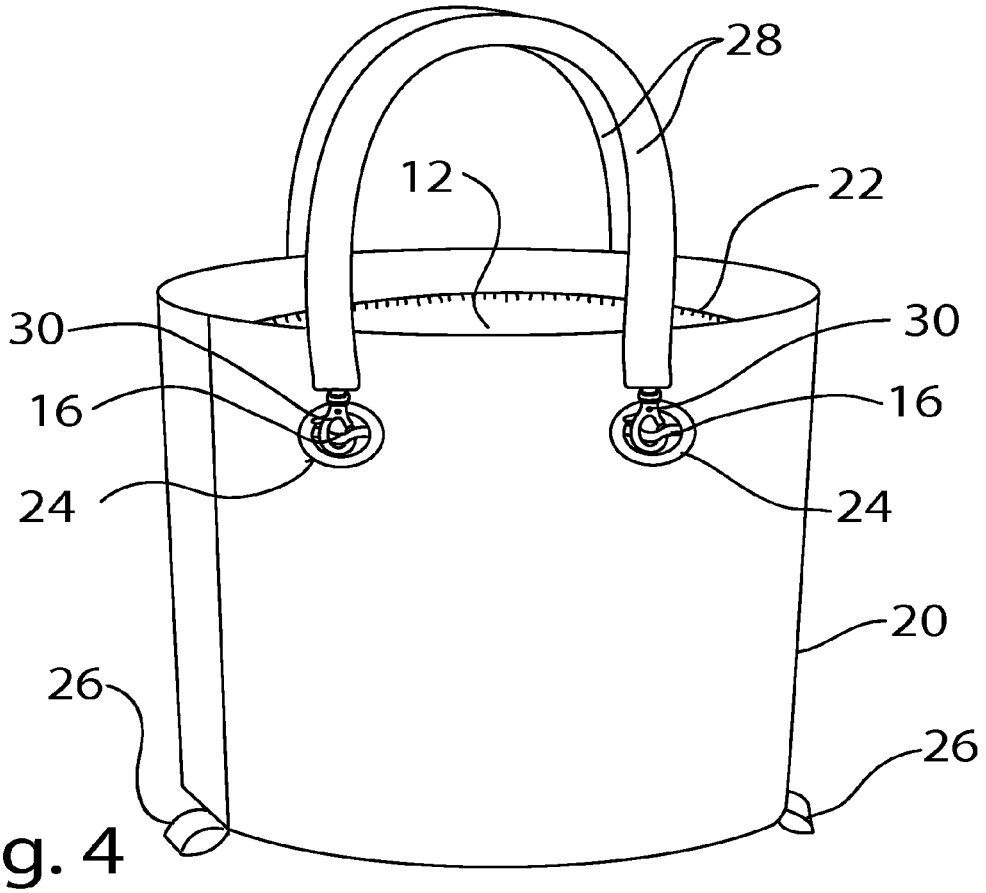
FIG. 4 shows the base purse and purse cover together, with the handles now affixed to the loops protruding from the base purse through the grommets on the purse cover.
Figure 5:
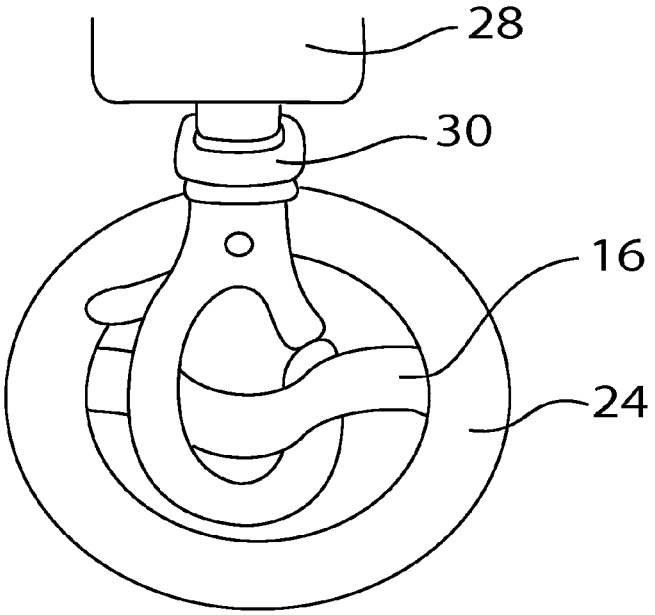
FIG. 5 shows a close-up perspective view of the hook at one end of the handle attaching to the loop on the base purse that protrudes through a grommet on the purse cover.
Figure 6:
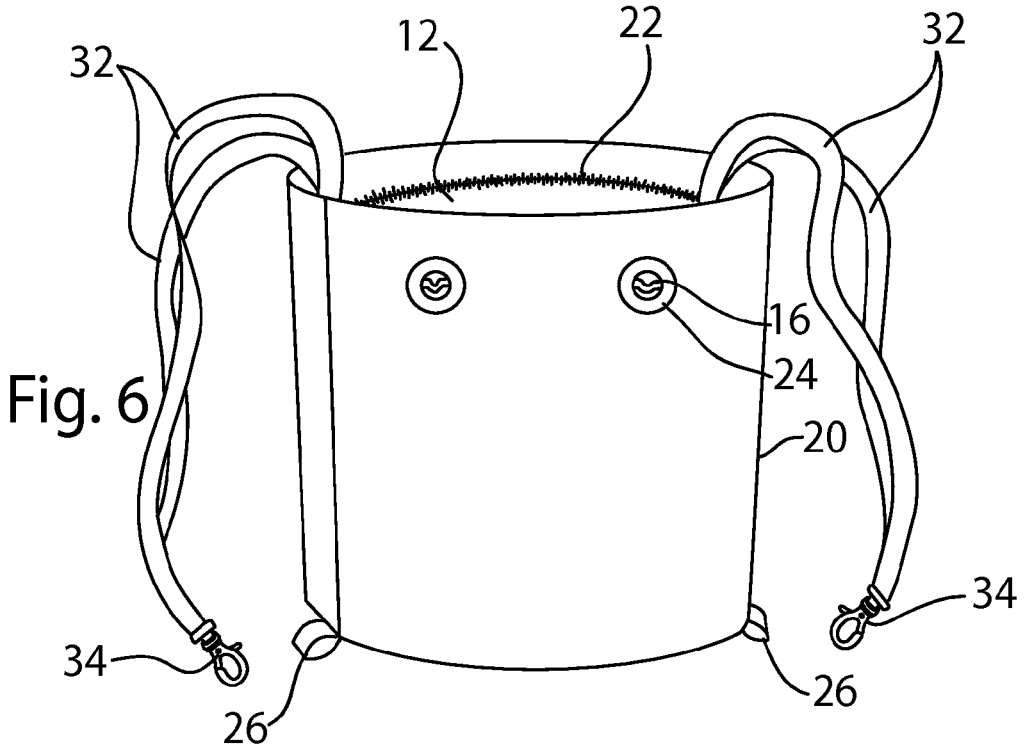
FIG. 6 shows the base purse and purse cover together, with the drawstring bag straps emerging from the inside of the base purse.

In general, the convertible purse of the present invention includes a base purse 12, a purse cover 20, and one or more types of straps. One or more fastener portions are provided along the perimeter of the top opening of the base purse, and One or more fastener portions are provided preferably below the top opening of the purse cover 20 such that, with the base purse 12 received entirely within the purse cover 20, the fastener portions of the base purse can be fastened to respective ones of the fastener portions of the purse cover to thereby secure the base purse in position within the purse cover. In the illustrated embodiment, the fastener portions of the base purse and the fastener portions of the purse cover are portions 18 and 22, respectively, of one or more zippers.

The base purse has a first side and a second side and the purse cover has a first side and a second side. These correspond to the front and back sides of the base purse 12 and the purse cover 20 that face toward the viewer and away from the viewer, respectively, in FIGS. 1-4. The purse cover 20 has a first pair of openings provided in the first side of the purse cover and a second pair of openings provided in the second side of the purse cover. These opening are preferably reinforced by grommets 24.

A first pair of attachment means is provided on the first side of the base purse 12. The first pair of openings of the purse cover 20 is in registry with and allows access to the first pair of attachment means of the base purse. A second pair of attachment means is provided on the second side of the base purse 12. The second pair of openings of the purse cover 20 is in registry with and allows access to the second pair of attachment means of the base purse. In the illustrated embodiment, the first pair of attachment means and the second pair of attachment means correspond to the loops 16 attached to the exterior surface of the base purse 12.

The first and second shoulder bag straps 28 are attached to the first pair of attachment means and the second pair of attachment means, respectively, to configure the convertible purse as a shoulder bag. The first shoulder bag strap 28 has first and second ends. Each of a first pair of connectors is attached to a respective one of the first and second ends of the first shoulder bag strap 28. Each of the first pair of connectors is capable of engagement with a respective one of the first pair of attachment means 16, through a respective one of the first pair of openings of the purse cover, to thereby securely attach each of the first and second ends of the first shoulder bag strap 28 to the respective one of the first pair of attachment means 16.

The second shoulder bag strap 28 has first and second ends, and each of a second pair of connectors is attached to a respective one of the first and second ends of the second shoulder bag strap 28. Each of the second pair of connectors is capable of engagement with a respective one of the second pair of attachment means 16, through a respective one of the second pair of openings of the purse cover 20, to thereby securely attach each of the first and second ends of the second shoulder bag strap 28 to the respective one of the second pair of attachment means 16. The convertible purse is configured as a shoulder bag when each of the first and second ends of the first shoulder bag strap 28 is securely attached to the respective one of the first pair of attachment means 16 and each of the first and second ends of the second shoulder bag strap 28 is securely attached to the respective one of the second pair of attachment means 16.

In the illustrated embodiment, the first pair of connectors and the second pair of connectors correspond to the snap hooks 30. Snap fasteners 14 are provided below the top opening of the base purse 12 to allow the top opening of the base purse to be releasably secured in a closed position.

The convertible purse of the present invention also includes first and second drawstring sleeves 36. The first drawstring sleeve 36 extends in proximity to a top edge of the first side of the base purse 12. The first drawstring sleeve has a first end portion that has a first opening 38 and a second end portion that has a second opening 38. The second drawstring sleeve 36 extends in proximity to a top edge of the second side of the base purse 12. The second drawstring sleeve 36 has a first end portion that has a first opening 38 and a second end portion that has a second opening 38. A first connection means 26 of the purse cover is provided on the exterior surface of the purse cover 20 at the first end portion of the closed bottom of the purse cover 20. A second connection means 26 of the purse cover is provided on the exterior surface of the purse cover 20 at the second end portion of the closed bottom of the purse cover 20. The first and second end portions of the base purse 12, the purse cover 20, the closed bottoms of the base purse and purse cover, the convertible purse, etc., correspond to the left and right sides of these items as viewed in FIGS. 1-4.

One or more drawstring bag straps 32 extend through and out of the first drawstring sleeve 36 and the second drawstring sleeve 36. A first drawstring bag strap connector 34 is attached to a first external portion of the one or more drawstring bag straps 32, and a second drawstring bag strap connector 34 is attached to a second external portion of the one or more drawstring bag straps 32. The one or more drawstring bag straps 32 are used to draw the top opening of the base purse 12, along with the top opening of the purse cover 20, to a closed configuration. When the shoulder bag straps 28 are not attached to the base purse 12 and when each of the first drawstring bag strap connector and the second drawstring bag strap connector is securely attached to a respective one of the first connection means 26 of the purse cover and the second connection means 26 of the purse cover, the convertible purse is configured as a drawstring-bag backpack. In the illustrated embodiment, each of the first drawstring bag strap connector and the second drawstring bag strap connector is a snap hook 34. In the illustrated embodiment, each of the first and second connection means of the purse cover is a loop 26 attached to the exterior surface of the purse cover 20.

In the illustrated embodiment, the one or more drawstring bag straps include a first drawstring bag strap 32 and a second drawstring bag strap 32. The first drawstring bag strap 32 is in the form of an endless loop that extends through both the first drawstring sleeve 36 and the second drawstring sleeve 36. A first portion of the first drawstring bag strap 32 extends between the first opening 38 of the first drawstring sleeve 36 and the first opening 38 of the second drawstring sleeve 36. A second portion of the first drawstring bag strap 32 extends between the second opening 38 of the first drawstring sleeve 36 and the second opening 38 of the second drawstring sleeve 36. The first portion of the first drawstring bag strap 32 is capable of being made longer than the second portion of the first drawstring bag strap.

The second drawstring bag strap 32 is also in the form of an endless loop that extends through both the first drawstring sleeve 36 and the second drawstring sleeve 36. A first portion of the second drawstring bag strap 32 extends between the second opening 38 of first drawstring sleeve 36 and the second opening 38 of the second drawstring sleeve 36. A second portion of the second drawstring bag strap 32 extends between the first opening 38 of the first drawstring sleeve 36 and the first opening 38 of the second drawstring sleeve 36. The first portion of the second drawstring bag strap 32 is capable of being longer than the second portion of the second drawstring bag strap.

The second drawstring bag strap connector 34 is attached to the first portion of the first drawstring bag strap 32, and the second drawstring bag strap connector 34 is attached to the first portion of the second drawstring bag strap 23. The first portion of the first drawstring bag strap 32 and the first portion of the second drawstring bag strap 32 are capable of being pulled in opposite directions to draw the top opening of the base purse to the closed configuration.

The convertible purse is provided with first and second drawstring bag strap pockets 40 to store the straps 32 when they are not in use. The first drawstring bag strap pocket 40 is provided on the interior surface of the base purse 12. The first drawstring bag strap pocket 40 has a top opening positioned below the first opening 38 of the first drawstring sleeve 36 and the first opening 38 of the second drawstring sleeve 36. The first drawstring bag strap pocket 40 is capable of receiving the first portion of the first drawstring bag strap 32 for storage when the first drawstring bag strap is not in use. The second drawstring bag strap pocket 40 is provided on the interior surface of the base purse 12. The second drawstring bag strap pocket 40 has a top opening positioned below the second opening 38 of the first drawstring sleeve 36 and the second opening 38 of the second drawstring sleeve 36. The second drawstring bag strap pocket is capable of receiving the first portion of the second drawstring bag strap 32 for storage when the second drawstring bag strap is not in use.

Each of the first and second drawstring bag strap connectors 34 is slidably attached to a respective one of the first portion of the first drawstring bag strap 32 and the first portion of the second drawstring bag strap 32 such that it can slide along the respective portions of the first and second drawstring bag straps 32.

The convertible purse is provided with first and second messenger bag strap connection means 46. The first messenger bag strap connection means 46 is attached to the base purse 12 near the top opening of the base purse at the first end portion of the base purse. The second messenger bag strap connection means 46 is attached to the base purse 12 near the top opening of the base purse at the second end portion of the base purse. The messenger bag strap 42 has first and second ends. Each of a pair of messenger bag strap connectors 44 is attached to a respective one of the first and second ends of the messenger bag strap 42. Each of the pair of messenger bag strap connectors 44 is capable of engagement with a respective one of the first and second messenger bag strap connection means 46 to thereby securely attach each of the first and second ends of the messenger bag strap 42 to a respective one of the first and second messenger bag strap connection means 46. When the shoulder bag straps 28 are not attached to the base purse and when the drawstring bag straps 32 are not in use, the pair of messenger bag strap connectors 44 can be engaged to a respective one of the first and second messenger bag strap connection means 46 to thereby convert the convertible purse to a messenger bag. In the illustrated embodiment, each of the first and second messenger bag strap connection means is a ring attached to the base purse, and each of the pair of messenger bag strap connectors is a snap hook.

Referring to FIGS. 1-11A, the present invention is directed to a convertible purse or bag with interchangeable covers that includes a base purse or bag 12, a set of purse or bag covers 20, a pair of shoulder bag straps 28, a messenger bag strap 42, and backpack strap 32. The base purse 12 is in the form of a pouch or bag having an open top. The sides of the base purse 12 extend downward from the top opening of the base purse to the bottom of the base purse. The bottom of the base purse 12 is closed off forming an open-topped pouch or container for carrying desired items such as those normally carried by a person in their purse or backpack. These items may, for example, include but are not limited to wallet, cash, keys, credit cards, identification cards, eye glasses, toiletries, etc. The base purse 12 and corresponding covers may be made in different sizes. For example, the purse and covers may be made large enough for the convertible purse to serve as a shopping bag, brief case, daypack, or other luggage. The base purse 12 may be made of a single panel or multiple panels sewn together. The base purse 12 has a larger dimension in the left-to-right direction than it has in the front-to-back direction as viewed in FIG. 1. This arrangement makes the base purse oblong when viewed from the top and allows the convertible purse to lie stably with its front side or back side against the user's side or back.

Each purse cover 20 is in the form of a pouch or bag having an open top. The sides of the purse cover 20 extend downward from the top opening of the purse cover 20 to the bottom of the purse cover 20. The bottom of the purse cover 20 is closed off forming an open-topped pouch or container for, at least, completely containing the base purse 12 even when the base purse 12 is full. The interior of the purse cover 20 closely follows the exterior of the base purse 12. Each purse cover 20 will preferably have a different color and/or pattern on its exterior to allow the user to match the appearance of the convertible purse to their various attires for an aesthetically pleasing appearance without having to purchase a separate bag for each attire and having to transfer the contents of their bag to another bag each time they change their attire. The purse cover 20 may be made of a single panel or multiple panels sewn together. As with the base purse, the purse cover 20 has a larger dimension in the left-to-right direction than it has in the front-to-back direction as viewed in FIG. 1. This arrangement makes the purse cover 20 oblong when viewed from the top and allows the convertible purse to lie stably with its front side or back side against the user's side or back. Convertible purse as used herein refers to the assembly including the base purse 12, the purse cover 20, and one or more of the various styles of straps enumerated above.

There is a zipper 18 provided along the perimeter of the top opening of the base purse 12 that connects to a matingly engageable zipper 22 located just inside the purse cover 20, slightly below the perimeter of the top opening of the purse cover 20. In the illustrated example, the zipper 18 is formed by two zippers that extend along the front side and back side, respectively, of the top opening of the base purse 12, and the zipper 22 is formed by two matching zippers that are provided on the interior of the purse cover 20 proximate the top opening of the purse cover that can be engaged by the corresponding zippers 18. Alternatively, the zippers 18 and 22 may each be one piece that extends for approximately the entire perimeter of the top opening of the base purse. With the base purse 12 inserted into the purse cover 20 such that the bottom of the base purse rests against the bottom of the purse cover and the sides of the base purse spread out such that their exterior surface is in face-to-face relationship with the interior surface of the purse cover, the zipper or zippers 18 register with the zipper or zippers 22 such that they can be fastened together to thereby detachably fasten or secure the base purse 12 to the interior of the purse cover 20.

Snap fasteners 14 are located on the interior of the base purse 12 proximate the top opening of the base purse, preferably, just below the perimeter of the top opening of the base purse with the male and female portions of the snap fasteners on opposite sides of the top opening of the base purse. The male and female portions of the snap fasteners 14 can be engaged together to secure the top opening of the base purse in the closed configuration, while the male and female portions of the snap fasteners 14 can be disengaged from one another to allow the top opening of the base purse to be placed in the open configuration to thereby allow access to the interior of the base purse.

Grommets 24 are provided in the sides of the purse cover 20. The grommets 24 define openings in the sides of the purse cover 20. Fabric loops 16, located on the outside of the base purse 12, can be pulled through the grommets 24 so as to protrude through the grommets 24. In the illustrated example, two grommets 24 are provided in the front of the purse cover 20 and two grommets 24 are provided in the back of the purse cover 20, all near the open top of the purse cover 20. The shoulder bag straps 28 have hooks 30 on the ends thereof that attach to the loops 16 that protrude through the grommets 24. In the illustrated example, two shoulder bag straps 28 are provided. The straps 28 are removable. The hooks 30 are preferably snap hooks that are attached via swiveling attachments to the respective ends of the shoulder bag straps 28.

Drawstring bag straps 32 are provided on the base purse 12. Drawstring sleeves 36 are formed at the front and rear sides of the top opening of the base purse 12. Each of the drawstring sleeves 36 extends along approximately the entire length of the respective side of the top opening of the base purse 12. Each of the drawstring sleeves 36 is open at both ends. The slits 38 form the open ends of the drawstring sleeves 36. Each of the two drawstring bag straps 32 is threaded through both drawstring sleeves 36 in accordance with the technique for a traditional drawstring bag. One strap 32 follows the perimeter of the top opening of the base purse 12 and has both ends emerging on one side of the base purse 12, and the other strap 32 follows the perimeter of the top opening of the base purse 12 and has both ends emerging on the other side. These straps emerge from slits 38 (see FIGS. 8 and 9) on either end of the inside top edge of the front and back sides of the base purse 12. The ends of each strap 32 are secured together so that each strap 32 forms an endless loop.

Each strap 32 is provided with a hook 34 that is preferably of the snap hook type. Each hook 34 is preferably attached by a swivel attachment to a loop or D-shaped ring that can slide on a portion of the respective strap 32 that extends out from a respective side of the base purse 12. When each strap 32 is pulled outward by the respective hook 34, each hook naturally moves to the location along its respective drawstring bag strap 32 that is farthest from the base purse 12.

Figure 7:
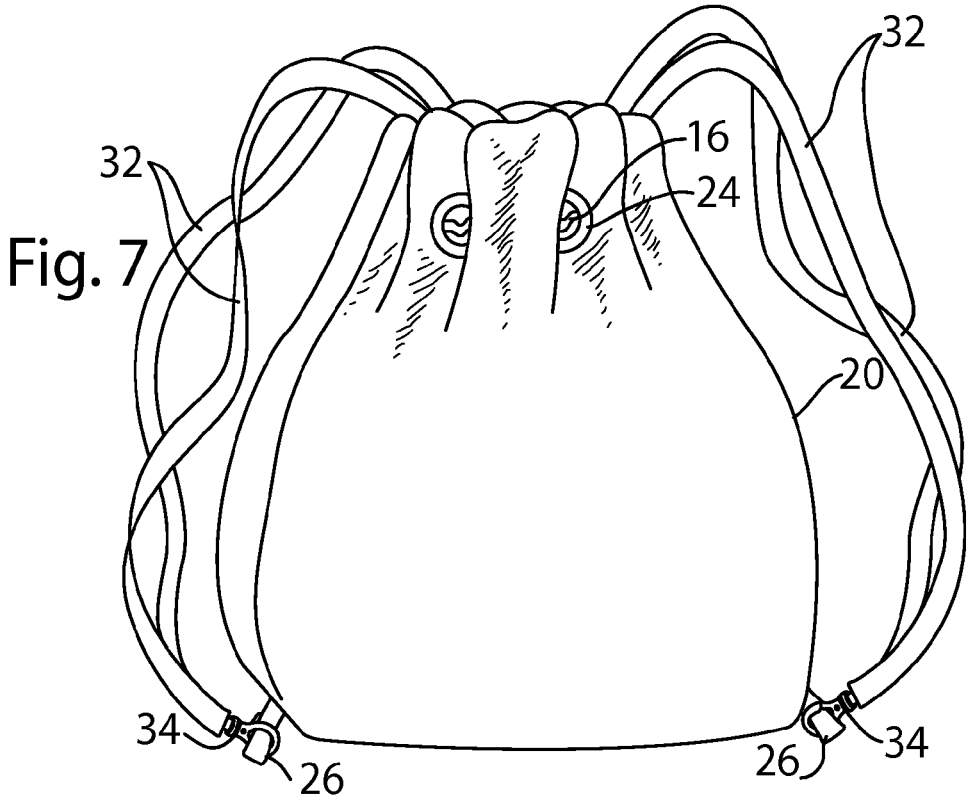
FIG. 7 shows the base purse and purse cover together, with the drawstring straps pulled tightly and the hooks at the ends of the drawstring straps affixed to the loops on the bottom of the purse cover.
Figure 8:
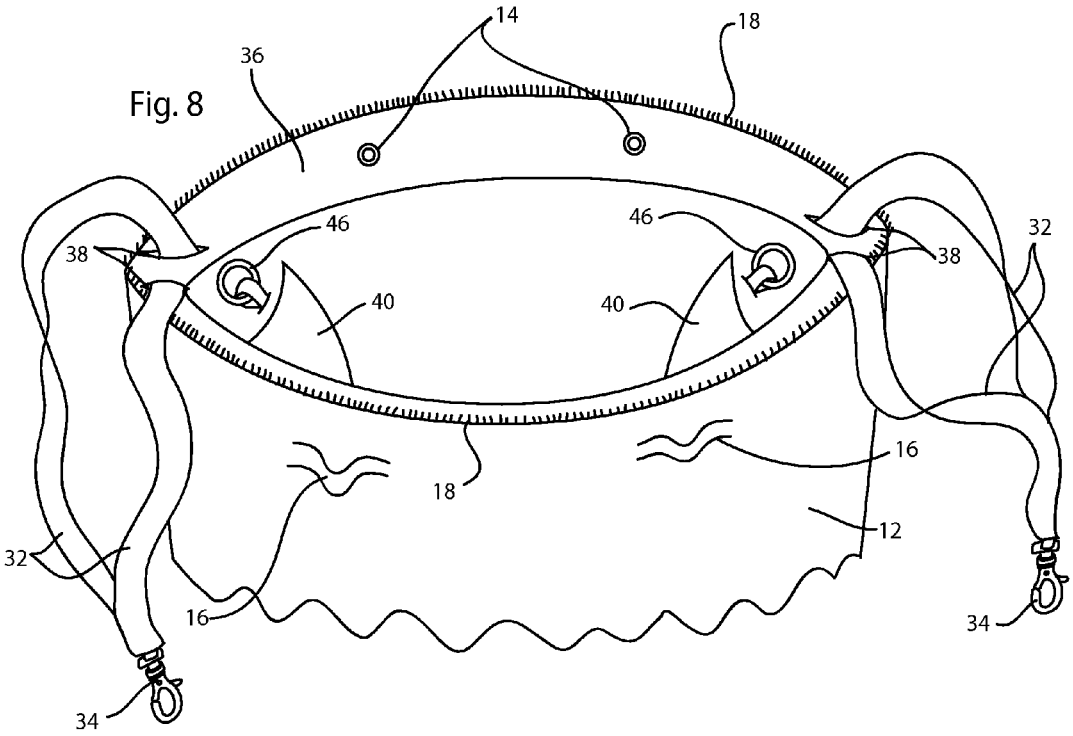
FIG. 8 shows a close-up perspective of the top of the base purse, illustrating how the drawstring straps emerge from the corners of the top inside perimeter of the base purse.

There are two fabric loops 26, one on each of the left and right ends of exterior of the bottom of the purse cover 20 as viewed in FIG. 7. The hooks 34 on the drawstring bag straps 32 hook onto respective loops 26 to form the "backpack straps" of the drawstring bag when the convertible purse is configured as a drawstring backpack. When the drawstring straps 32 are pulled, the top openings of the base purse 12 and the purse cover 20 bunch up, along with the drawstring sleeves 36, to close the convertible purse in traditional drawstring-bag fashion. If desired, cord locks or toggles may be used on the straps 32 to more securely hold the top opening of the convertible purse in the closed configuration.

Figure 9:
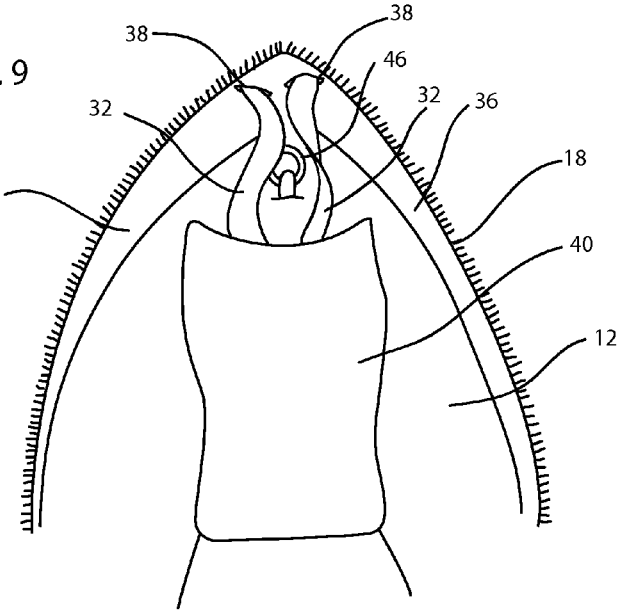
FIG. 9 shows a detail view of one of the inside corners of the base purse, illustrating how the drawstring straps emerge from the corners of the top inside perimeter of the base purse, and how the straps can then rest inside the corner pockets when not in use.
Figure 10:
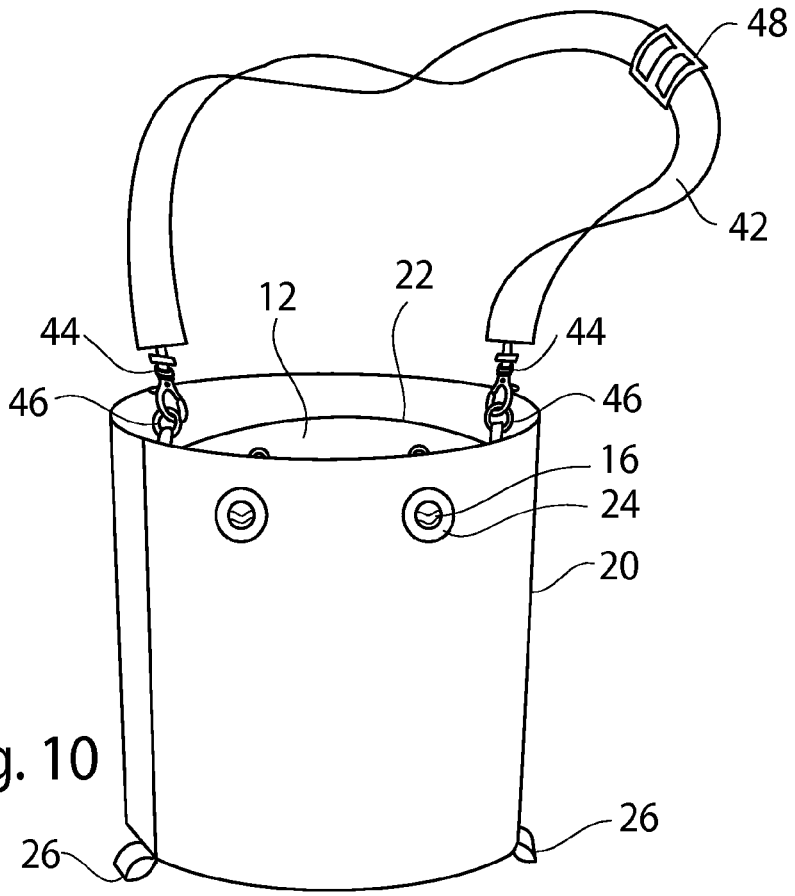
FIG. 10 shows a front view of the base purse and purse cover together, with the hooks on the ends of the messenger bag strap attached to loops on the base purse.
Figure 11:
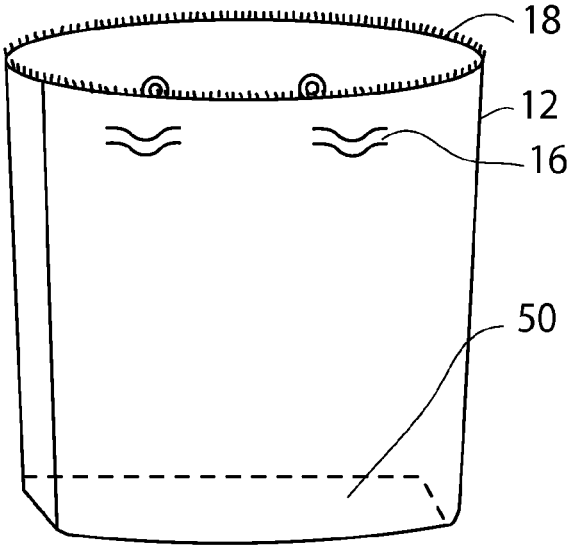
FIG. 11 is a perspective view showing in phantom lines the space where the stiff, removable rectangle of material shown in FIG. 11A sits to help provide a flat, relatively rigid bottom to the purse or to the purse and cover assembly.
Figure 11A:
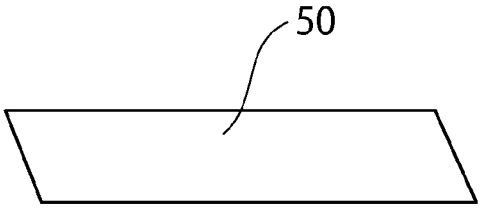
FIG. 11A is a perspective view showing the stiff, removable rectangle of material that fits in the bottom of the purse to help provide a flat, relatively rigid bottom to the purse or to the purse and cover assembly.

When not in use, the drawstring straps 32 tuck into inside pockets 40 in the base purse 12 as shown in FIG. 9. Each pocket 40 and its opening is positioned below a respective pair of the slits 38 on the interior of the base purse 12. One of the pockets 40 is positioned at the left side of the interior of the base purse 12 and one of the pockets 40 is positioned at the right side of the interior of the base purse 12 as viewed in FIG. 8.

There is a separate messenger bag strap 42 that also has hooks 44 on either end of it. Hooks 44 are preferably of the snap hook type. Two metal rings 46 are securely fastened to the interior of the base purse 12, one on each side of the base purse 12. One of the rings 46 is positioned at the left side of the interior of the base purse 12 and one of the rings 46 is positioned at the right side of the interior of the base purse 12 as viewed in FIG. 8. Each of the rings 46 is located near and below the top opening of the base purse 12. Each of the hooks 44 on the ends of the messenger bag strap 42 attaches to a respective one of the metal rings 46 to form the messenger bag configuration of the convertible purse shown in FIG. 10. The messenger bag strap 42 is provided with a strap slide 48 that allows the length of the strap 42 to be adjusted. A plastic strap slide 48 is preferred.

There is a removable bottom plate 50 that sits on the bottom of the inside of the base purse 12. The bottom plate 50 is a rectangular piece of plastic or other firm material, encased in fabric. It lies at the bottom of the base to help the bag maintain its shape, but it can be easily removed if the user wants a more flexible bottom when the purse is being used as a drawstring bag. The bottom plate 50 allows the convertible purse to stand upright on a flat surface like, for example, a table or counter top.

In order to change the cover on the convertible purse with interchangeable covers, a user removes the shoulder bag straps 28 from the loops 16 that protrude through the grommets 24. She then disconnects the base purse zipper 18 from the purse cover zipper 22 by unzipping the zippers 18 and 22. She removes the cover 20. Then she puts another cover 20 onto the base purse 12 and fastens zippers 18 and 22 together to secure the base purse 12 inside the new purse cover 20. Then she reattaches the shoulder bag straps 28 to the loops 16 through the grommets 24.

In order to convert the convertible purse with interchangeable covers from a shoulder bag to a drawstring-bag backpack, a user removes the shoulder bag straps 28 from the loops 16 that protrude through the grommets 24. She then takes out the drawstring-bag straps 32 that are resting inside inner pockets 40 in the base purse 12. She takes the hooks 34 on the straps 32 and attaches them to the loops 26 on the outside bottom of the purse cover 20. She then pulls the drawstring straps 32 at the top of the bag in order to close the bag in the traditional fashion of a drawstring bag. The bag is now closed and the backpack straps are formed; the user can now wear it on her back. If the user wants the bottom of the bag to be more flexible and soft while using the purse as a drawstring bag, she can also remove the firm rectangular bottom 50 from inside the base.

In order to change the convertible purse to a messenger bag, the user removes the shoulder bag straps 28 from the loops 16 that protrude through the grommets 24. She then attaches the hooks 44 on the ends of the separate messenger bag strap 42 to the metal rings 46 located just inside the base purse 12. The convertible purse can now be worn as a messenger bag.

When the convertible purse is being used as a shoulder bag or messenger bag, the user can close the convertible purse using the snaps 14. When the convertible purse is used as a drawstring-bag backpack, the drawstring mechanism keeps the convertible purse closed.

The illustrated embodiment of the convertible purse is capable of various modifications while still adhering to the fundamental concepts of the present invention. Instead of fabric loops 16 on the base purse that are accessible or protrude through the grommets 24, there could be other types of loops, such as metal, cord, or string. There could also be buttons that protrude or are accessible through the grommets 24. Instead of grommets 24 on the purse cover, there could be button holes through which buttons or other elements could protrude. Instead of metal rings 46 onto which the messenger bag strap 42 attaches, there could be fabric loops or another method of attachment. Instead of snaps 14 to close the convertible purse, there could be a zipper or other method of closure. The convertible purse could convert to a backpack without the drawstring-bag function; for example, external straps could attach to the loops 26 on the bottom of the purse cover and also to the metal rings 46 on the inside of the base purse on either side to form backpack straps. Instead of a zipper to affix the purse cover 20 to the base purse 12, there could be other means of attachment, such as snaps, buttons, or hook-and-loop fasteners (VELCRO™). The firm rectangular plate 50 that helps the convertible purse maintain its shape can be made out of cardboard, plastic, or any other firm material. It does not have to be encased in fabric, and it does not have to be removable. The lengths of the drawstring strap 32 and shoulder bag strap 42 can include adjustment mechanisms, such as plastic or metal strap slides. The length of the messenger bag strap 42 can be adjusted in other ways besides the plastic strap slide 48. The convertible purse could include different types of removable straps made out of different types of materials.

Messenger bags and cross-body bags are terms of art for bags that employ the same type of strap as the messenger bag strap 42 illustrated herein, which is a strap worn over the shoulder on the side of the body opposite the side at which the bag is located to allow hands-free carrying of the bag. Accordingly, the terms messenger bag and cross-body bag and the terms messenger bag strap and cross-body bag strap are considered interchangeable in the present application.

It is to be understood that the present invention is not limited to the embodiments described above, but encompasses any and all embodiments within the scope of the following claims.

The invention claimed is:

1. A convertible purse comprising:

a base purse having a top opening, said top opening of said base purse having a perimeter, said base purse having a first side and a second side;

one or more fastener portions provided along said perimeter of said top opening of said base purse;

a purse cover having a top opening, said purse cover having a first side and a second side, said purse cover having a first pair of openings provided in said first side of said purse cover and a second pair of openings provided in said second side of said purse cover;

one or more fastener portions provided below said top opening of said purse cover such that with said base purse received entirely within said purse cover said fastener portions of said base purse are fastened to respective ones of said fastener portions of said purse cover to thereby secure said base purse in position within said purse cover;

a first pair of attachment means provided on said first side of said base purse, said first pair of openings of said purse cover being in registry with and allowing access to said first pair of attachment means of said base purse;

a second pair of attachment means provided on said second side of said base purse, said second pair of openings of said purse cover being in registry with and allowing access to said second pair of attachment means of said base purse;

a first shoulder bag strap having first and second ends;

a first pair of connectors, each of said first pair of connectors being attached to a respective one of said first and second ends of said first shoulder bag strap, each of said first pair of connectors being capable of engagement with a respective one of said first pair of attachment means through a respective one of said first pair of openings of said purse cover to thereby securely attach each of said first and second ends of said first shoulder bag strap to said respective one of said first pair of attachment means;

a second shoulder bag strap having first and second ends; and a second pair of connectors, each of said second pair of connectors being attached to a respective one of said first and second ends of said second shoulder bag strap, each of said second pair of connectors being capable of engagement with a respective one of said second pair of attachment means through a respective one of said second pair of openings of said purse cover to thereby securely attach each of said first and second ends of said second shoulder bag strap to said respective one of said second pair of attachment means, wherein said convertible purse is configured as a shoulder bag when each of said first and second ends of said first shoulder bag strap is securely attached to said respective one of said first pair of attachment means and each of said first and second ends of said second shoulder bag strap is securely attached to said respective one of said second pair of attachment means.

2. The convertible purse of claim 1, wherein said fastener portions of said base purse and said fastener portions of said purse cover are portions of one or more zippers.

3. The convertible purse of claim 1, wherein said fastener portions of said base purse and said fastener portions of said purse cover are portions of one or more zippers.

4. The convertible purse of claim 1, wherein snap fasteners are provided below said top opening of said base purse to allow said top opening of said base purse to be releasably secured in a closed position.

5. The convertible purse of claim 1, wherein said base purse has an exterior surface and wherein each of said first pair of attachment means and each of said second pair of attachment means is a loop attached to said exterior surface of said base purse.

6. The convertible purse of claim 5, wherein each of said first pair of connectors and each of said second pair of connectors is a snap hook.

7. The convertible purse of claim 6, wherein said fastener portions of said base purse and said fastener portions of said purse cover are portions of one or more zippers.

8. The convertible purse of claim 1, wherein said purse cover has an exterior surface and a closed bottom, said closed bottom of said purse cover has first and second end portions, and wherein the convertible purse further comprises:

a first drawstring sleeve extending in proximity to a top edge of said first side of said base purse, said first drawstring sleeve having a first end portion having a first opening and a second end portion having a second opening;

a second drawstring sleeve extending in proximity to a top edge of said second side of said base purse, said second drawstring sleeve having a first end portion having a first opening and a second end portion having a second opening;

a first connection means of said purse cover provided on said exterior surface of said purse cover at said first end portion of said closed bottom of said purse cover;

a second connection means of said purse cover provided on said exterior surface of said purse cover at said second end portion of said closed bottom of said purse cover;

one or more drawstring bag straps extending through and out of said first drawstring sleeve and said second drawstring sleeve;

a first drawstring bag strap connector attached to a first external portion of said one or more drawstring bag straps; and a second drawstring bag strap connector attached to a second external portion of said one or more drawstring bag straps, wherein said one or more drawstring bag straps can be used to draw said top opening of said base purse to a closed configuration, and wherein when said shoulder bag straps are not attached to said base purse and when each of said first drawstring bag strap connector and said second drawstring bag strap connector is securely attached to a respective one of said first connection means of said purse cover and said second connection means of said purse cover, the convertible purse is configured as a drawstring-bag backpack.

9. The convertible purse of claim 8, wherein said base purse has a first end portion and a second end portion, and wherein the convertible purse further comprises:

a first messenger bag strap connection means attached to said base purse near said top opening of said base purse at said first end portion of said base purse;

a second messenger bag strap connection means attached to said base purse near said top opening of said base purse at said second end portion of said base purse;

a messenger bag strap having first and second ends;

a pair of messenger bag strap connectors, each of said pair of messenger bag strap connectors being attached to a respective one of said first and second ends of said messenger bag strap, each of said pair of messenger bag strap connectors being capable of engagement with a respective one of said first and second messenger bag strap connection means to thereby securely attach each of said first and second ends of said messenger bag strap to said respective one of said first and second messenger bag strap connection means;

wherein when said shoulder bag straps are not attached to said base purse and when said one or more drawstring bag straps are not in use, said pair of messenger bag strap connectors can be engaged to a respective one of said first and second messenger bag strap connection means to thereby convert the convertible purse to a messenger bag.

10. The convertible purse of claim 9, wherein each of said pair of messenger bag strap connectors is a snap hook.

11. The convertible purse of claim 9, further comprising one or more additional purse covers that are interchangeable with said purse cover to allow a user to change the appearance of the convertible purse.

12. The convertible purse of claim 9, wherein each of said first and second messenger bag strap connection means is a ring attached to said base purse.

13. The convertible purse of claim 8, wherein said one or more drawstring bag straps include a first drawstring bag strap and a second drawstring bag strap, said first drawstring bag strap is in the form of an endless loop that extends through both said first drawstring sleeve and said second drawstring sleeve, a first portion of said first drawstring bag strap extends between said first opening of said first drawstring sleeve and said first opening of said second drawstring sleeve, and a second portion of said first drawstring bag strap extends between said second opening of said first drawstring sleeve and said second opening of said second drawstring sleeve, said first portion of said first drawstring bag strap being capable of being longer than said second portion of said first drawstring bag strap, wherein said second drawstring bag strap is in the form of an endless loop that extends through both said first drawstring sleeve and said second drawstring sleeve, a first portion of said second drawstring bag strap extends between said second opening of said first drawstring sleeve and said second opening of said second drawstring sleeve, and a second portion of said second drawstring bag strap extends between said first opening of said first drawstring sleeve and said first opening of said second drawstring sleeve, said first portion of said second drawstring bag strap being capable of being longer than said second portion of said second drawstring bag strap, wherein said first drawstring bag strap connector is attached to said first portion of said first drawstring bag strap, wherein said second drawstring bag strap connector is attached to said first portion of said second drawstring bag strap, and wherein said first portion of said first drawstring bag strap and said first portion of said second drawstring bag strap are capable of being pulled in opposite directions to draw said top opening of said base purse to said closed configuration.

14. The convertible purse of claim 13, wherein said base purse has an interior surface, and wherein the convertible purse further comprises:

a first drawstring bag strap pocket provided on said interior surface of said base purse, said first drawstring bag strap pocket having a top opening positioned below said first opening of said first drawstring sleeve and said first opening of said second drawstring sleeve, and said first drawstring bag strap pocket is capable of receiving said first portion of said first drawstring bag strap for storage when said first portion of said first drawstring bag strap is not in use; and a second drawstring bag strap pocket provided on said interior surface of said base purse, said second drawstring bag strap pocket having a top opening positioned below said second opening of said first drawstring sleeve and said second opening of said second drawstring sleeve, and said second drawstring bag strap pocket is capable of receiving said first portion of said second drawstring bag strap for storage when said first portion of said second drawstring bag strap is not in use.

15. The convertible purse of claim 14, wherein each of said first drawstring bag strap connector and said second drawstring bag strap connector is slidably attached to a respective one of said first portion of said first drawstring bag strap and said first portion of said second drawstring bag strap such that it can slide along said respective one of said first portion of said first drawstring bag strap and said first portion of said second drawstring bag strap.

16. The convertible purse of claim 15, wherein each of said first drawstring bag strap connector and said second drawstring bag strap connector is a snap hook.

17. The convertible purse of claim 16, wherein each of said first and second connection means of said purse cover is a loop attached to said exterior surface of said purse cover.

18. A convertible purse comprising:

a base purse having a top opening, said top opening of said base purse having a perimeter;

one or more fastener portions provided along said perimeter of said top opening of said base purse;

a purse cover having a top opening, an exterior surface, and a closed bottom, said closed bottom of said purse cover having first and second end portions;

one or more fastener portions provided below said top opening of said purse cover such that with said base purse received entirely within said purse cover said fastener portions of said base purse are fastened to respective ones of said fastener portions of said purse cover to thereby secure said base purse in position within said purse cover;

a first drawstring sleeve extending in proximity to a top edge of said first side of said base purse, said first drawstring sleeve having a first end portion having a first opening and a second end portion having a second opening;

a second drawstring sleeve extending in proximity to a top edge of said second side of said base purse, said second drawstring sleeve having a first end portion having a first opening and a second end portion having a second opening;

a first connection means of said purse cover provided on said exterior surface of said purse cover at said first end portion of said closed bottom of said purse cover;

a second connection means of said purse cover provided on said exterior surface of said purse cover at said second end portion of said closed bottom of said purse cover;

one or more drawstring bag straps extending through and out of said first drawstring sleeve and said second drawstring sleeve;

a first drawstring bag strap connector attached to a first external portion of said one or more drawstring bag straps; and a second drawstring bag strap connector attached to a second external portion of said one or more drawstring bag straps, wherein said one or more drawstring bag straps can be used to draw said top opening of said base purse to a closed configuration, and wherein each of said first drawstring bag strap connector and said second drawstring bag strap connector is securely attached to a respective one of said first connection means of said purse cover and said second connection means of said purse cover to configure the convertible purse as a drawstring-bag backpack.

19. A convertible purse comprising:

a base purse having a top opening, a first end portion, and a second end portion, said top opening of said base purse having a perimeter;

one or more fastener portions provided along said perimeter of said top opening of said base purse;

a purse cover having a top opening;

one or more fastener portions provided below said top opening of said purse cover such that with said base purse received entirely within said purse cover said fastener portions of said base purse are fastened to respective ones of said fastener portions of said purse cover to thereby secure said base purse in position within said purse cover;

a first messenger bag strap connection means attached to said base purse near said top opening of said base purse at said first end portion of said base purse;

a second messenger bag strap connection means attached to said base purse near said top opening of said base purse at said second end portion of said base purse;

a messenger bag strap having first and second ends; and a pair of messenger bag strap connectors, each of said pair of messenger bag strap connectors being attached to a respective one of said first and second ends of said messenger bag strap, each of said pair of messenger bag strap connectors being capable of engagement with a respective one of said first and second messenger bag strap connection means to thereby securely attach each of said first and second ends of said messenger bag strap to said respective one of said first and second messenger bag strap connection means, wherein said pair of messenger bag strap connectors can be engaged to a respective one of said first and second messenger bag strap connection means to thereby convert the convertible purse to a messenger bag.

* * * * *